US012000594B2

(12) United States Patent
Jeong et al.

(10) Patent No.: US 12,000,594 B2
(45) Date of Patent: Jun. 4, 2024

(54) DOOR AND HOME APPLIANCE HAVING THE SAME

(71) Applicant: Samsung Electronics Co., Ltd., Suwon-si (KR)

(72) Inventors: Heesoo Jeong, Suwon-si (KR); Woojoo Kim, Suwon-si (KR); Sihwan Kim, Suwon-si (KR); Hoseung Seo, Suwon-si (KR); Dongmyeong Lee, Suwon-si (KR); Hongman Chang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 257 days.

(21) Appl. No.: 17/301,359

(22) Filed: Mar. 31, 2021

(65) Prior Publication Data

US 2021/0302026 A1 Sep. 30, 2021

(30) Foreign Application Priority Data

Mar. 31, 2020 (KR) ..... 10-2020-0038942

(51) Int. Cl.
*F24C 15/02* (2006.01)
*F24C 15/08* (2006.01)

(52) U.S. Cl.
CPC ..... *F24C 15/023* (2013.01); *F24C 15/028* (2013.01); *F24C 15/08* (2013.01)

(58) Field of Classification Search
CPC ..... F24C 15/023; F24C 15/028; F24C 15/08; F24C 15/36; F27D 1/18
USPC ..... 126/190, 544
See application file for complete search history.

(56) References Cited

U.S. PATENT DOCUMENTS 5,029,571 A 7/1991 Trosin
5,568,712 A 10/1996 Jenkins et al.
6,709,029 B2 * 3/2004 Cole ..... F24C 15/022 292/110

(Continued)

FOREIGN PATENT DOCUMENTS

CN 201416937 Y 3/2010
CN 202885035 U 4/2013

(Continued)

OTHER PUBLICATIONS

International Search Report dated Jul. 9, 2021 in connection with International Patent Application No. PCT/KR2021/003900, 3 pages.

(Continued)

*Primary Examiner* — Allen R. B. Schult
*Assistant Examiner* — William C Weinert

(57) ABSTRACT

A home appliance includes a body and a door. The body includes a chamber. The door is configured to open and close the chamber. The door includes an upper flange forming an upper surface of the door. The door also includes a side flange forming a side surface of the door. The door further includes a support flange formed by being bent at an upper end of the side flange. The support flange includes a support portion that is configured to come in contact with the upper flange and a bending portion connecting the side flange to the support portion. The upper flange is arranged on the support portion such that one end of the upper flange is located on an upper portion of the bending portion.

14 Claims, 10 Drawing Sheets

330:331,332,333

(56) References Cited

U.S. PATENT DOCUMENTS

| | | | | |
|---|---|---|---|---|
| 9,151,505 | B2 * | 10/2015 | Kim | F24C 15/02 |
| 10,120,123 | B2 | 11/2018 | Ochi et al. | |
| 2004/0177840 | A1 * | 9/2004 | Brock | F24C 3/087 126/41 R |
| 2006/0027230 | A1 | 2/2006 | Jung | |
| 2013/0019853 | A1 | 1/2013 | Kim et al. | |
| 2016/0334113 | A1 * | 11/2016 | Lee | F24C 15/08 |
| 2017/0059177 | A1 * | 3/2017 | Yancey | B21D 39/032 |
| 2021/0131171 | A1 * | 5/2021 | Choi | F24C 15/02 |

FOREIGN PATENT DOCUMENTS

| | | | | |
|---|---|---|---|---|
| CN | 107466355 | A | 12/2017 | |
| DE | 102010027918 | A1 * | 10/2011 | F25D 23/02 |
| GB | 2099988 | A * | 12/1982 | F24C 15/02 |
| GB | 2186967 | A | 8/1987 | |
| KR | 10-2003-0092194 | A | 12/2003 | |
| KR | 10-1064060 | B1 | 9/2011 | |
| KR | 10-2013-0011485 | A | 1/2013 | |
| KR | 20-2017-0000172 | U | 1/2017 | |
| KR | 10-2018-0017616 | A | 2/2018 | |
| WO | 2011131438 | A2 | 10/2011 | |

OTHER PUBLICATIONS

Supplementary European Search Report dated Nov. 23, 2022, in connection with European Application No. 21780979.7, 10 pages.

* cited by examiner

330:331,332,333

DOOR AND HOME APPLIANCE HAVING THE SAME

CROSS-REFERENCE TO RELATED APPLICATION

This application is based on and claims priority under 35 U.S.C. § 119 to Korean Patent Application No. 10-2020-0038942, filed on Mar. 31, 2020 in the Korean Intellectual Property Office, the disclosure of which is incorporated herein by reference.

BACKGROUND

1. Field

The present disclosure relates to a door having an improved structure of a corner portion and a home appliance having the same.

2. Description of the Related Art

A home appliance has a chamber that performs a function of an appliance, such as a cooking chamber or a washing chamber, and includes a door for opening and closing the chamber.

The door includes a chassis forming the external appearance of the door, glass, and an inner frame. The chassis may be formed of a single plate, and may be bent in vertical and lateral directions to form the external appearance of the door. In this case, the chassis may be cut at a corner portion for the bending, which may form a sharp edge at the corner portions, and a user may be injured by the sharp edge.

In order to prevent such a limitation, the conventional technology employs a structure in which a corner portion at which a sheared surface is formed is welded or is shielded with a separate cap member, so that a welding operation is added or a separate cap member is required in a process of manufacturing the door.

SUMMARY

Therefore, it is an aspect of the disclosure to provide a door including a chassis having a simple structure capable of preventing a sharp edge of the door from being exposed, and a home appliance having the same.

It is another aspect of the disclosure to provide a door that may be produced without additional parts or additional processes, such as welding, and a home appliance having the same.

Additional aspects of the disclosure will be set forth in part in the description which follows and, in part, will be obvious from the description, or may be learned by practice of the disclosure.

According to an aspect of the disclosure, there is provided a home appliance including: a body including a chamber; and a door provided to open and close the chamber, wherein the door includes: an upper flange forming an upper surface of the door; a side flange forming a side surface of the door; and a support flange formed by being bent at an upper end of the side flange, the support flange including a support portion configured to come in contact with the upper flange and a bending portion connecting the side flange to the support portion, wherein the upper flange is arranged on the support portion such that one end of the upper flange is located on an upper portion of the bending portion.

The support portion may include a support surface having a planar shape, the bending portion may include a curved surface connected to the support surface, and an edge of the one end of the upper flange may be arranged on a boundary between the support surface and the curved surface.

The support surface may support the upper flange while in contact with a lower surface of the upper flange.

The side flange may include: a cut portion formed on the upper end of the side flange; and a flat panel portion separated from the bending portion by the cut portion.

The one end of the upper flange may be spaced apart from a plane including an outer surface of the side flange by a distance that is smaller than a thickness of the flat panel portion, and a part of the upper flange may cover a part of an upper surface of the flat panel portion.

The support flange may be a first flange, and the door may further include: a rear flange formed by being bent from the side flange to form a part of a rear surface of the door; and a second support flange formed by being bent at an upper end of the rear flange to support the upper flange.

The support portion may be a first support portion, and the bending portion may be a first bending portion, and the second support flange may include a second support portion configured to come in contact with the upper flange and a second bending portion connected to the second support portion.

The second support portion may come in contact with a lower surface of the upper flange, and the upper flange may be arranged on the second support portion such that an other end of the upper flange is located on an upper portion of the second bending portion.

The rear flange may be a first rear flange, and the door may further include a second rear flange formed by being bent from the upper flange and fixed to the first rear flange.

The door may further include a third support flange connecting the first support flange to the second support flange.

The door may include: a first rear flange formed by being from the side flange to form a part of a rear surface of the door; and a second rear flange formed by being from the upper flange to form a part of the rear surface of the door, wherein the second rear flange may be fixed to the first rear flange.

The first rear flange may include a first fastening hole, and the second rear flange may include a second fastening hole corresponding to the first fastening hole.

The first rear flange may include a recess portion formed to allow a part of the second rear flange to be inserted thereinto, and the first fastening hole may be formed in one surface of the recess portion.

The second rear flange may be coupled to the first rear flange by a fastening member that passes through the first fastening hole and the second fastening hole.

According to an aspect of the disclosure, there is provided a door used for a home appliance, the door including: a chassis including an upper flange forming an upper surface of the door, and forming a front surface, a side surface, and a part of a rear surface of the door; and a support flange formed on a corner upper portion of the chassis to support the upper flange, and including a support surface having a planar shape and a curved surface connected to the support surface, the upper flange comes in contact with the support surface such that one end of the upper flange is located on an upper portion of the curved surface adjacent to a boundary between the support surface and the curved surface.

The chassis may include a side flange forming a side surface of the door and a first rear flange forming a part of the rear surface of the door, and the support flange may be formed on a corner of the chassis formed by the side flange and the first rear flange.

The support flange may include a first support flange formed by being bent from the side flange, a second support flange formed by being bent from the first rear flange, and a third support flange formed between the first support flange and the second support flange.

The chassis may further include a second rear flange formed by being bent from the upper flange and forming a part of the rear surface of the door, and the second rear flange may be fixed to the first rear flange.

The first rear flange may include a recess portion formed to allow a part of the second rear flange to be inserted thereinto and a first fastening hole formed in the recess portion, the second rear flange may include a second fastening hole corresponding to the first fastening hole, and the second rear flange may be fixed to the first rear flange by a fastening member that passes through the first fastening hole and the second fastening hole.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
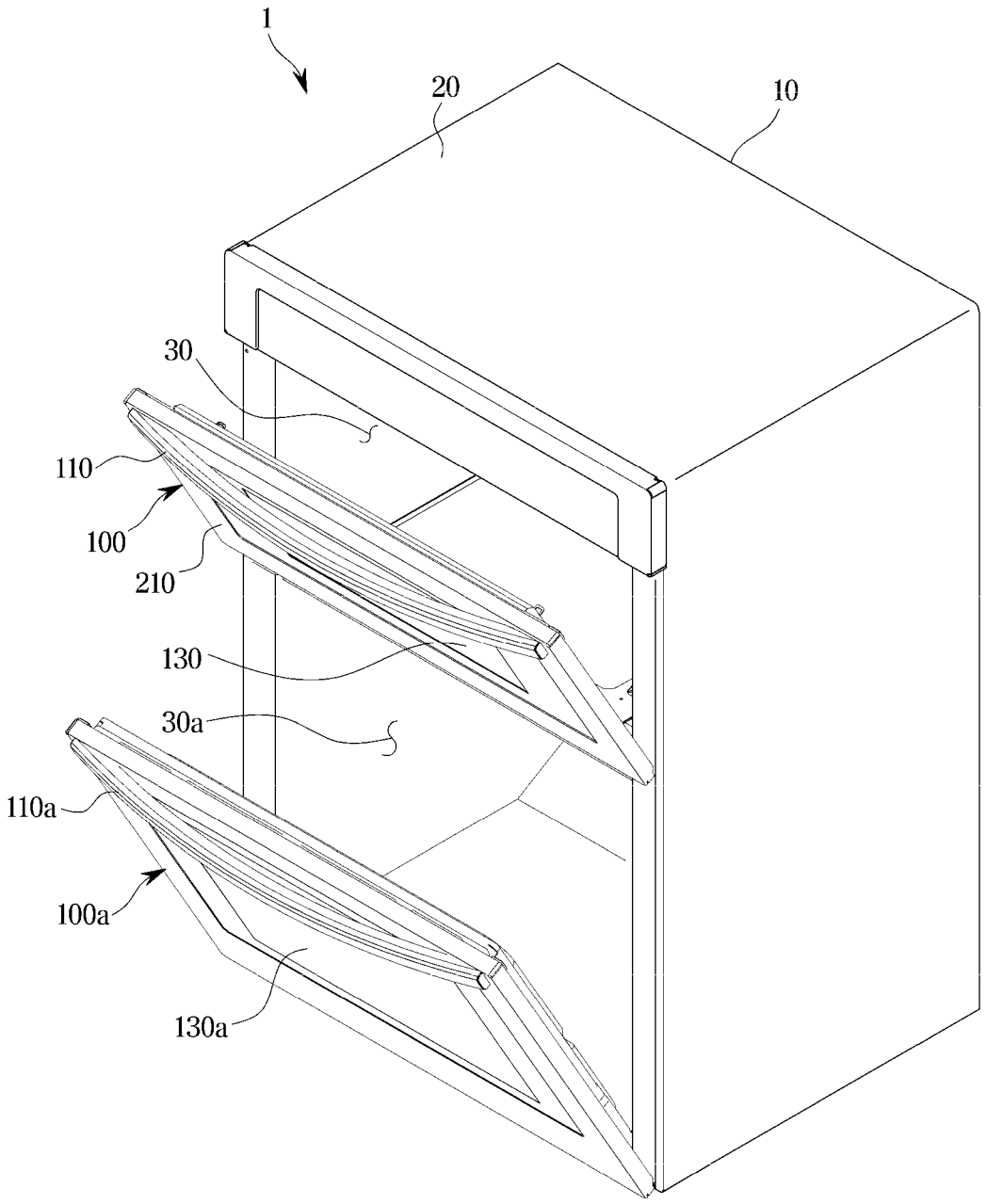
FIG. 1 illustrates a perspective view of a home appliance according to an embodiment of the disclosure.

FIGS. 1 through 10, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The embodiments set forth herein and illustrated in the configuration of the disclosure are only the most preferred embodiments and are not representative of the full the technical spirit of the disclosure, so it should be understood that they may be replaced with various equivalents and modifications at the time of the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise.

It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another.

For example, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

The terms "front", "rear", "upper", "lower", "top", and "bottom" as herein used are defined with respect to the drawings, but the terms may not restrict the shape and position of the respective components.

Hereinafter, embodiments of the disclosure will be described in detail with reference to the accompanying drawings.

FIG. 1 illustrates a perspective view of a home appliance according to an embodiment of the disclosure. In the disclosure, an oven is used as an example of the home appliance, but the disclosure is not limited thereto, and the disclosure may be applied to any home appliance including a door.

Referring to FIG. 1, an oven 1 may include a main body 10 including an inner case (not shown) and an outer case 20. A plurality of chambers 30 and 30*a* may be formed in the inner case (not shown). The outer case 20 may be coupled to the outside of the inner case (not shown) to form the external appearance of the oven 1. The inner case (not shown) and the outer case 20 each may have a substantially box shape with an open front surface.

The plurality of chambers 30 and 30*a* may include a first chamber 30 and a second chamber 30*a*. The first chamber 30 may be formed above the second chamber 30*a*. The plurality of chambers 30 and 30*a* may be used as a cooking chamber, and also may be used for various uses, such as storing food.

The oven 1 may include a plurality of doors 100 and 100*a* provided on the front surface of the main body 10 to open and close the plurality of chambers 30 and 30*a*, respectively. The plurality of doors 100 and 100*a* may include a first door 100 for opening and closing the first chamber 30 and a second door 100*a* for opening and closing the second chamber 30*a*.

The first door 100 may include a first front glass 130 provided so that the inside of the oven 1 is seen from the outside. The second door 100*a* may also include a second front glass 130*a*.

A first door handle 110 gripped by a user may be provided at an upper portion of the front surface of the first door 100 so that the first chamber 30 is opened and closed by the first door 100. A second door handle 110*a* gripped by a user may be provided at an upper portion of the front surface of the second door 100*a* so that the second chamber 30*a* is opened and closed by the second door 100*a*.

Various components constituting the oven 1 may be built in a space between the inner case (not shown) in which the plurality of chambers 30 and 30*a* are formed and the outer case 20 forming the external appearance of the oven 1. In addition, a machine room (not shown) may be provided to accommodate electric components that control the operations of various accessory components.

In FIG. 1, the oven 1 is illustrated as having the plurality of doors 100 and 100*a* and the plurality of chambers 30 and 30, but the disclosure is not limited thereto, and the aspect of the disclosure may also be applied to an oven having one door and one chamber.

Hereinafter, the first door 100 will be described in detail. The same description may apply to the second door 100*a*.

Figure 2:
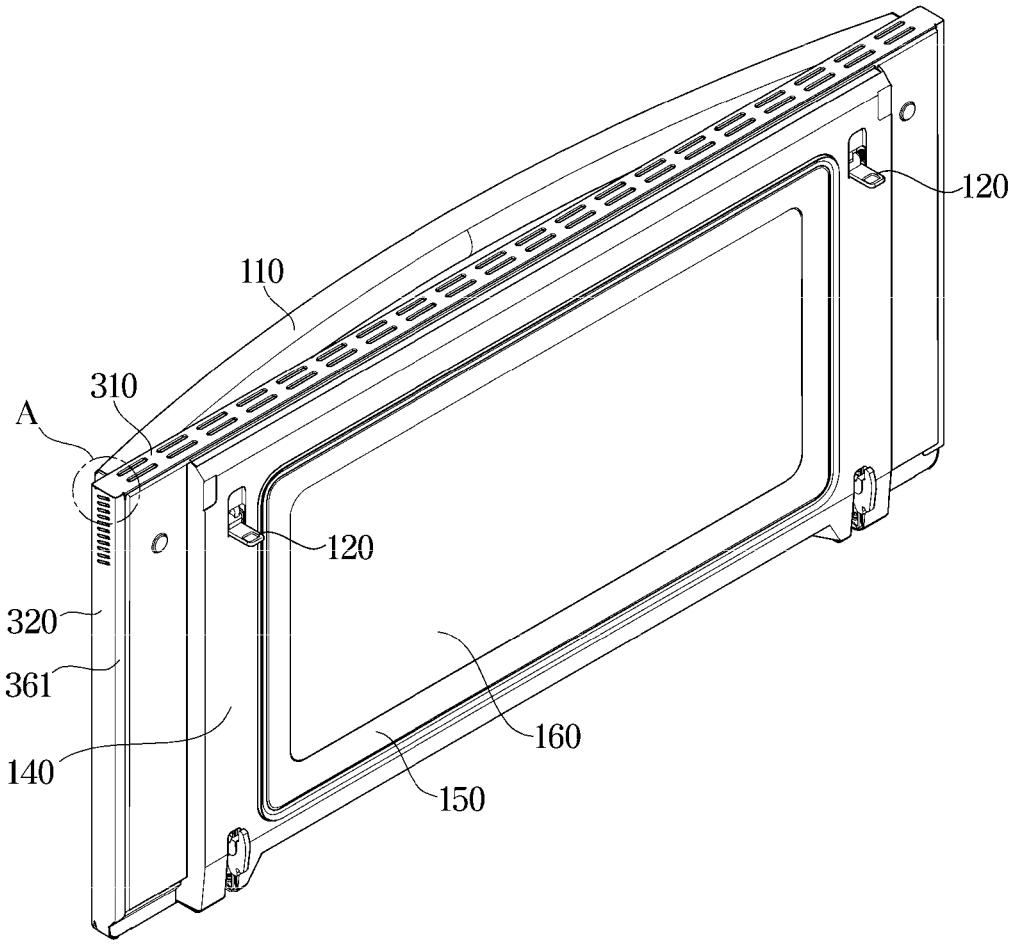
FIG. 2 illustrates a rear perspective view of a door of the home appliance shown in FIG. 1 according to an embodiment of the disclosure.
Figure 3:
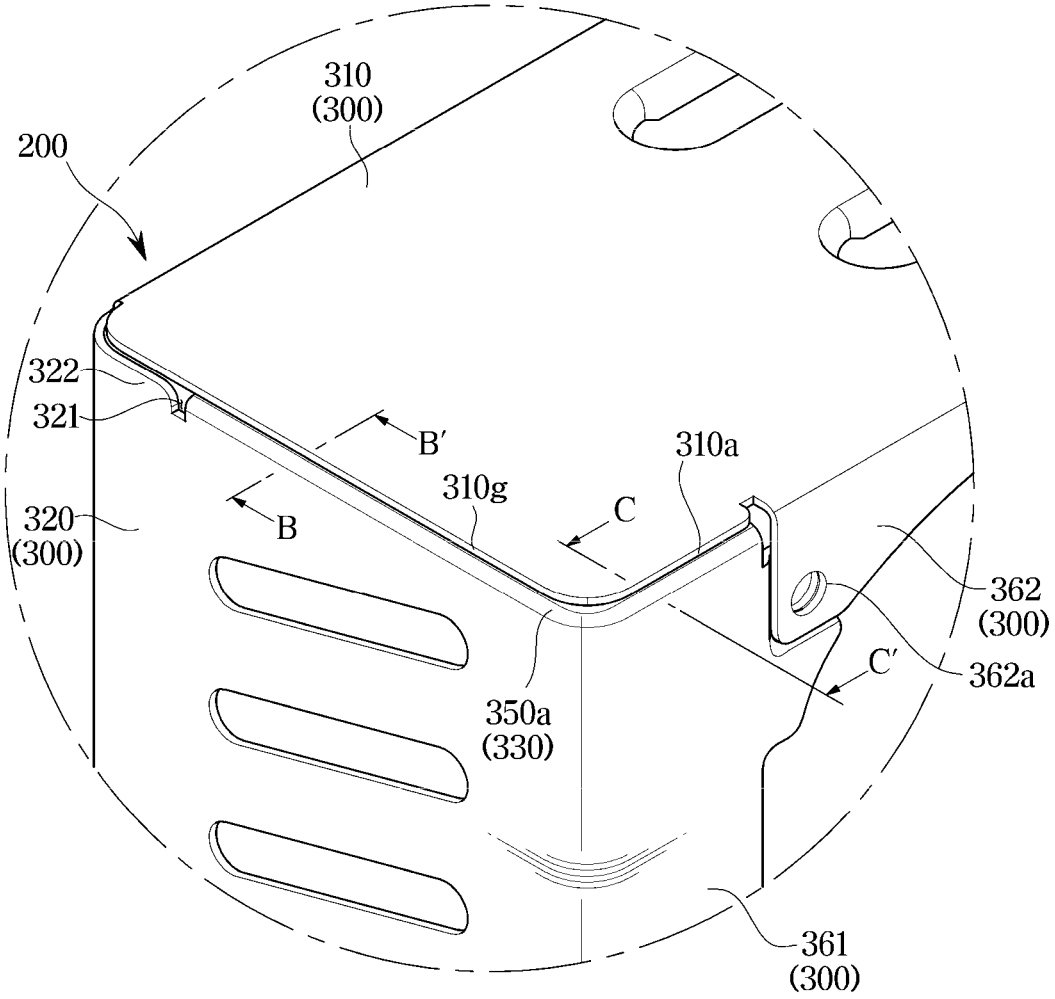
FIG. 3 illustrates an enlarged perspective view showing portion A of a chassis of the door shown in FIG. 2 according to an embodiment of the disclosure.
Figure 4:
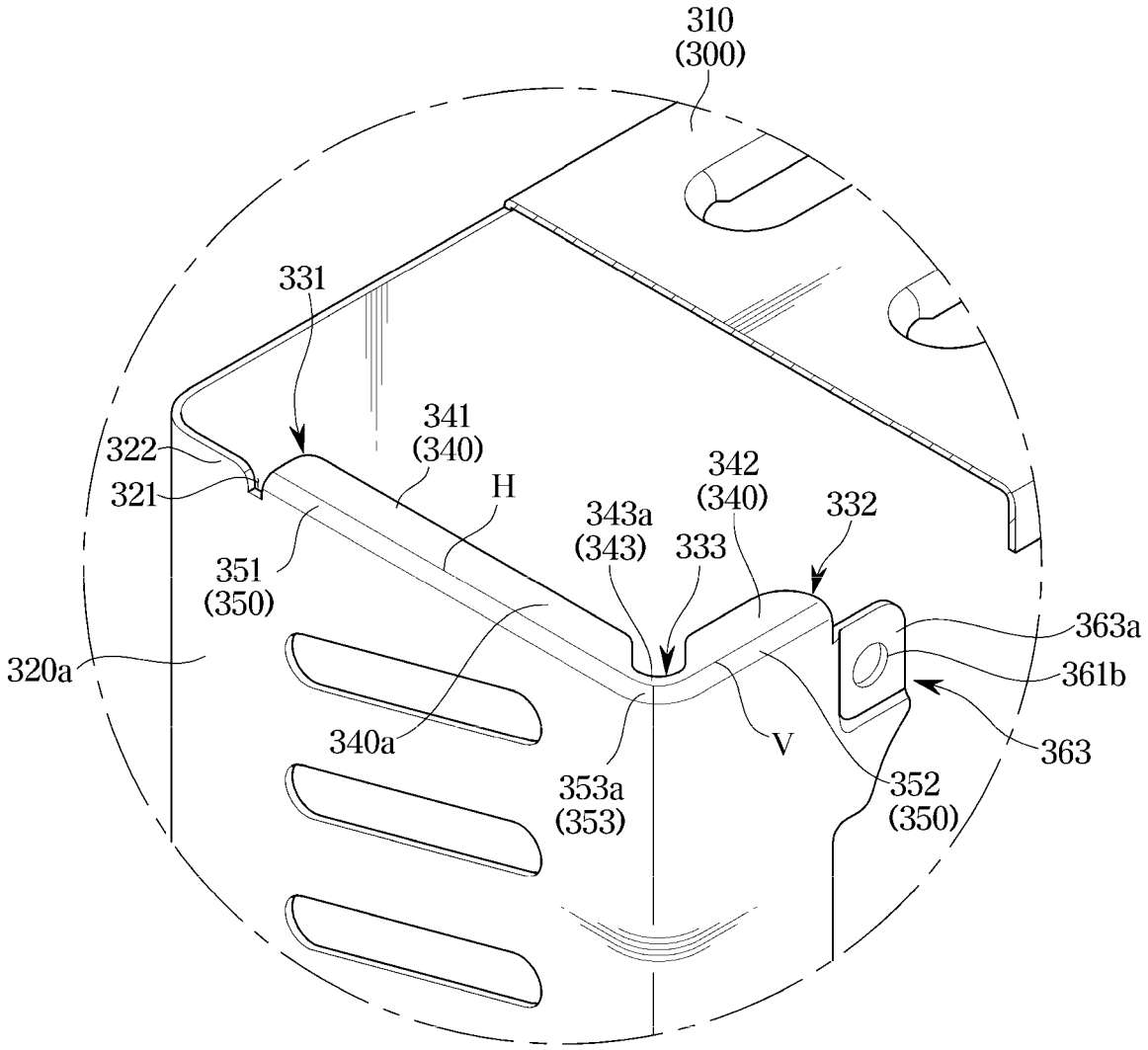
FIG. 4 illustrates a view of a portion of an upper flange cut away from the chassis shown in FIG. 3 according to an embodiment of the disclosure.
Figure 5:
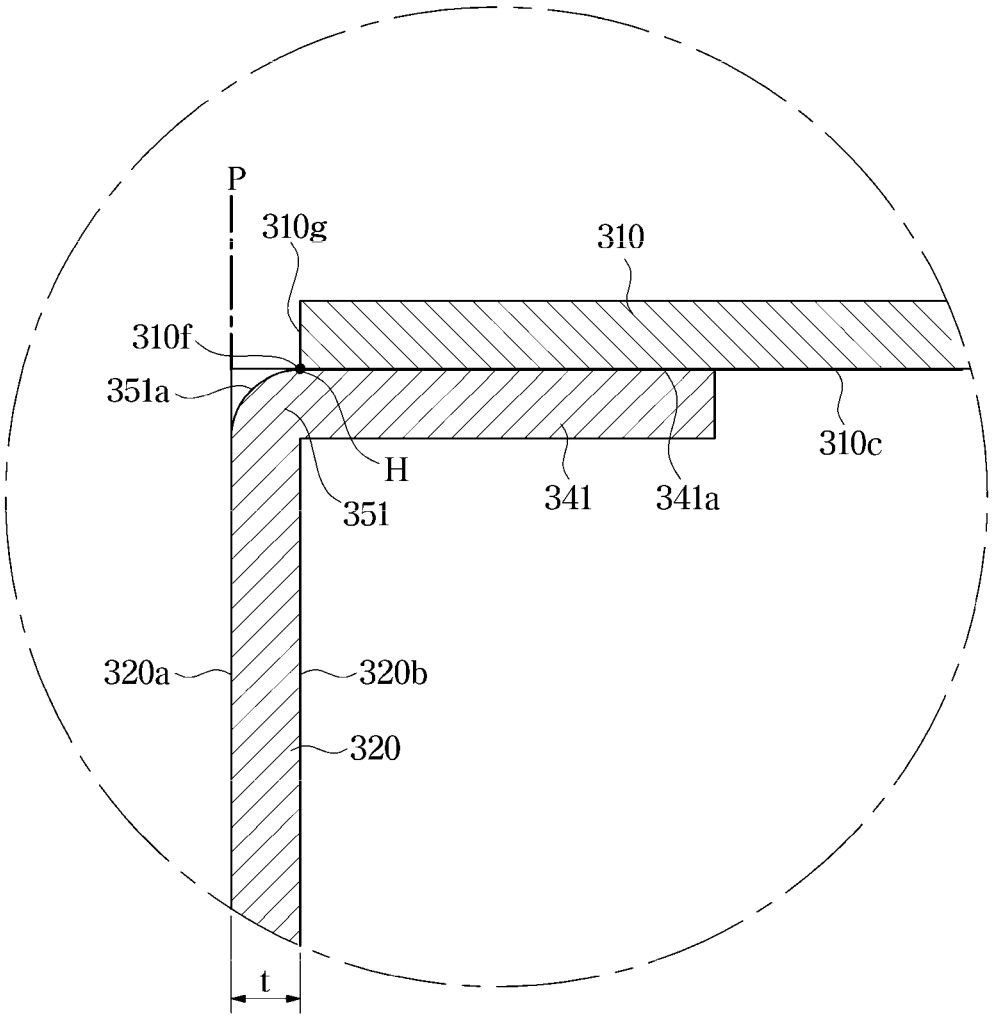
FIG. 5 illustrates a view taken along line B-B' of FIG. 3, which shows a first support flange and an upper flange according to the first embodiment of the disclosure.
Figure 6:
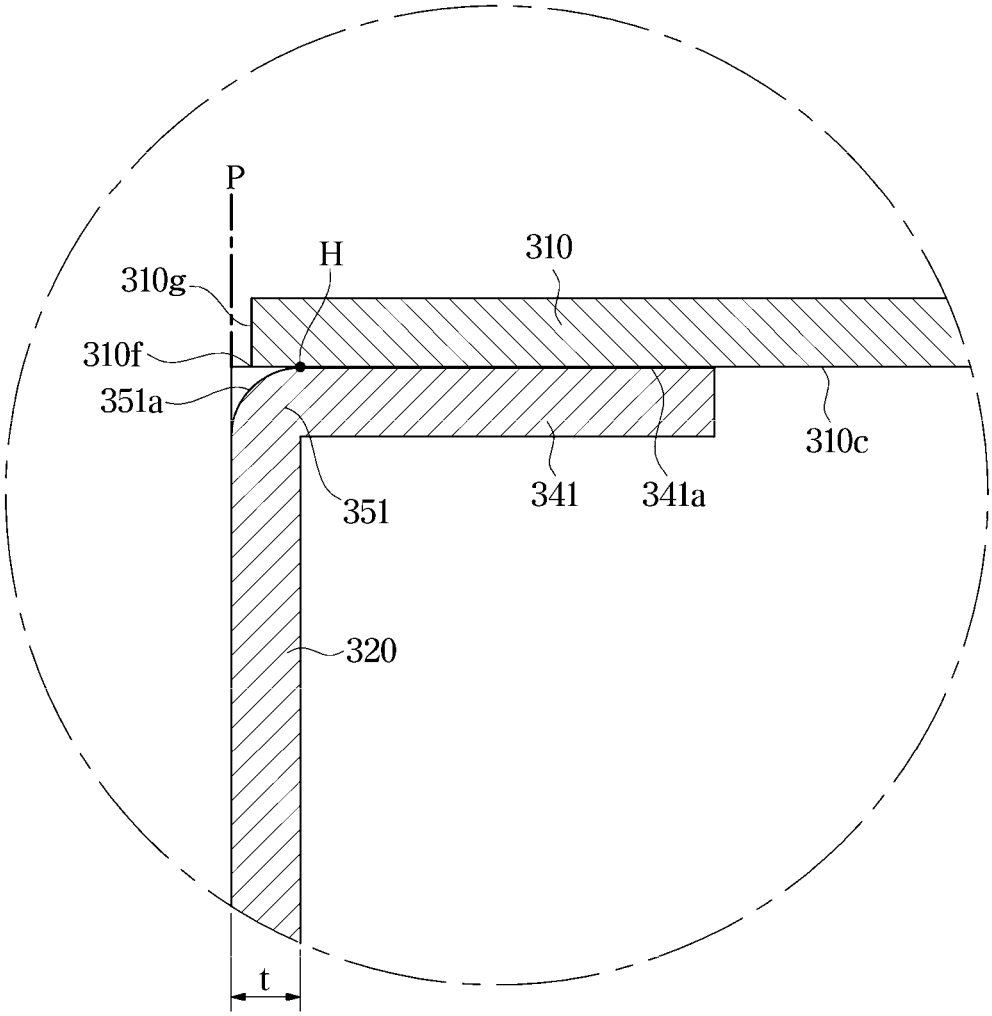
FIG. 6 illustrates a view taken along line B-B' of FIG. 3, which shows a first support flange and an upper flange according to the second embodiment of the disclosure.
Figure 7:
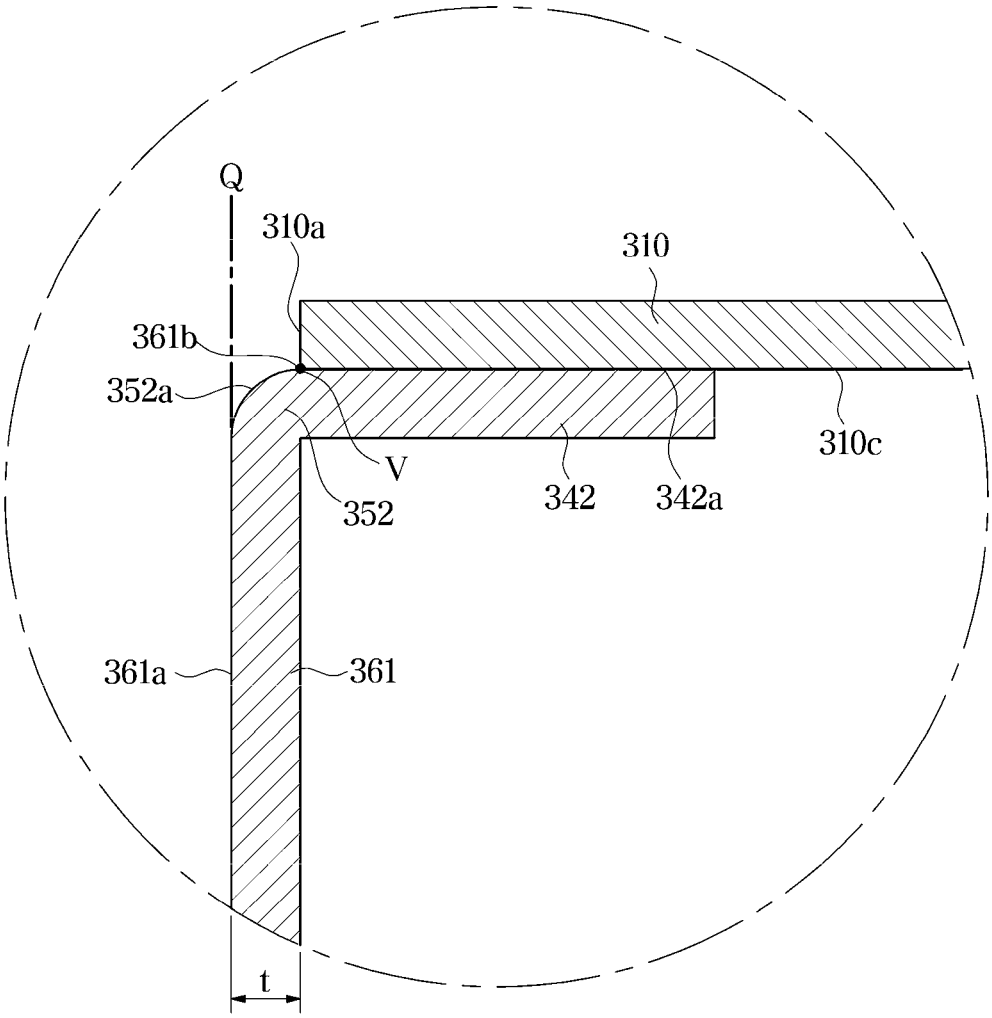
FIG. 7 illustrates a view taken along line C-C' of FIG. 3, which shows a second support flange and an upper flange according to the first embodiment of the disclosure.

FIG. 2 illustrates a rear perspective view of a door of the home appliance shown in FIG. 1 according to an embodiment of the disclosure. FIG. 3 illustrates an enlarged perspective view showing portion A of a chassis of the door shown in FIG. 2 according to an embodiment of the disclosure. FIG. 4 illustrates a view of a portion of an upper flange cut away from the chassis shown in FIG. 3 according to an embodiment of the disclosure. FIG. 5 illustrates a view taken along line B-B' of FIG. 3, which shows a first support flange and an upper flange according to the first embodiment of the disclosure. FIG. 6 illustrates a view taken along line B-B' of FIG. 3, which shows a first support flange and an upper flange according to the second embodiment of the disclosure. FIG. 7 illustrates a view taken along line C-C' of FIG. 3, which shows a second support flange and an upper flange according to the first embodiment of the disclosure.

Referring to FIGS. 2 to 5 and 7, the first door 100 (hereinafter referred to as a door) may include a chassis 200 forming the external appearance of the door 100. The chassis 200 may include a front panel 210 forming the front surface of the door 100. The chassis 200 may be provided in a substantially box shape by bending edges of the front panel 210. The detailed structure of the chassis 200 will be described below.

The door 100 may include a rear glass 160 and a fixing frame 150 for fixing the rear glass 160. The rear glass 160 may be accommodated inside the fixed frame 150. In addition, the rear glass 160 may be disposed to seal the first chamber 30.

The door 100 may include a rear panel 140. The rear panel 140 may be mounted on the rear of the door 100 to form a part of the rear surface of the door 100. The rear panel 140 may cover components included in the door 100 so that the rear appearance of the door 100 is formed to be neat.

The door 100 may include a plurality of locking devices 120. The plurality of locking devices 120 may be provided on the door 100 so that the door 100 is fixed to and released from the main body 10. The plurality of locking devices 120 may be accommodated inside the rear panel 140. In the drawing, the locking device 120 is provided in plural, but the disclosure is not limited thereto, and the door 100 may include one locking device 120.

The door 100 may include a chassis 200 forming the front surface, the upper surface, the lower surface, the side surfaces, and parts of the rear surface of the door.

The chassis 200 may include the front panel 210 forming the front surface of the door 100. The front panel 210 may be formed of a single panel. Edges of the front panel 210 are bent so that the chassis 200 may be formed in an approximately box shape having a part that is open. The front panel 210 may be bent to form the lower surface of the door 100.

The chassis 200 may include a plurality of flanges 300 connected to the front panel 210. The flanges 300 may include an upper flange 310, side flanges 320, a support flange 330, and first and second rear flanges 361 and 362 to be described below. The front panel 210 and the plurality of flanges 300 may be integrally formed with each other. The chassis 200 may be formed of a single metal plate.

The chassis 200 may include a pair of the side flanges 320 that are formed by being bent at side portions of the front panel 210 to form the side surfaces of the door 100. The side flange 320 may have a flat panel shape perpendicular to the upper flange 310. The side flanges 320 may be formed by being bent at both side ends of the front panel 210 in a direction of an inner side of the door 100. The inner side direction may be a direction toward the chamber 30 of the oven 1.

The chassis 200 may include a first rear flange 361 that is formed by being bent from the side flange 320 to be parallel with the front panel 210 to form a part of the rear surface of the door 100. The first rear flange 361 may be formed by being bent from one end of the side flange 320 toward the central portion of the door 100.

The chassis 200 may include the upper flange 310 that is formed by being bent at an upper portion of the front panel 210 to form the upper surface of the door 100. The upper flange 310 may be formed by being bent from the top of the front panel 210 in a direction of the inner side of the door 100.

The chassis 200 may include a second rear flange 362 that is formed by being bent at one end of the upper flange 310 downward to be parallel with the front panel 210 to form a part of the rear surface of the door 100. In detail, the second rear flange 362 may be formed by being bent at the rear end of the upper flange 310. The length of the second rear flange 362 in a direction perpendicular to the side flange 320 may be smaller than the length of the upper flange 310 in the direction perpendicular to the side flange 320. Accordingly, a rear surface 310*a* and a rear end edge 310*b* of the upper flange 310 may be disposed at each lateral side of the second rear flange 362. The rear end edge 310*b* may correspond to an edge formed by the rear surface 310*a* of the upper flange 310 and a lower surface 310*c* of the upper flange 310.

The chassis 200 may include a first support flange 331 that is formed by being bent at the upper end of the side flange 320. The first support flange 331 may include a pair of first support flanges 331 that are respectively formed by being bent at the upper ends of the pair of side flanges 320.

The first support flange 331 may come in contact with the upper flange 310, and may support the upper flange 310. The first support flange 331 may include a first support portion 341 configured to come in contact with the upper flange 310 and a first bending portion 351 configured to connect the first support portion 341 to the side flange 320.

The first support portion 341 may have a flat panel shape parallel to the upper flange 310. The first support portion 341 may include a first support surface 341*a* configured to come in contact with the lower surface 310*c* of the upper flange 310. In detail, the first support surface 341*a* may have a planar shape, and may correspond to an upper surface of the first support portion 341.

The first bending portion 351 may have a shape of a curved plate having one end connected to the side flange 320 and the other end connected to the first support portion 341. The first bending portion 351 may include a first curved surface 351*a* having a curved shape. The first curved surface 351*a* may have a constant or varying curvature. The first curved surface 351*a* may correspond to an outer surface of the first bending portion 351 and may be connected to the first support surface 341*a*.

As the first curved surface 351*a* and the first support surface 341*a* are connected to each other, a boundary H may be formed, and the first support portion 341 and the first bending portion 351 may be distinguished from each other based on the boundary H.

The upper flange 310 may be disposed on the first support portion 341 so that the side portion of the upper flange 310 is positioned on the boundary H between the first support portion 341 and the first bending portion 351. In detail, as the upper flange 310 comes in contact with the first support surface 341*a*, a side end edge 310*f* of the upper flange 310 is caused to be located at a position corresponding to an upper portion of the first bending portion 351 and also corresponding to the boundary H between the first support surface 341*a* and the first curved surface 351*a*. The side end edge 310*f* of the upper flange 310 may correspond to an edge formed by a side surface 310*g* of the upper flange 310 and the lower surface 310*c* of the upper flange 310.

Since the side surface 310*g* of the upper flange 310 extends from the side end edge 310*f* of the upper flange 310 in a direction perpendicular to the first support surface 341*a*, the side surface 310*g* of the upper flange 310 may be located on the boundary H between the first support surface 341*a* and the first curved surface 351*a*.

However, the disclosure is not limited thereto. FIG. 6 illustrates a view taken along line B-B' of FIG. 3, which shows the first support flange and the upper flange according to the second embodiment.

Referring to FIG. 6, the upper flange 310 may be disposed on the first support portion 341 so that the side portion is located in a space above the first bending portion 351. In detail, as the upper flange 310 comes in contact with the first support surface 341*a*, the side end edge 310*f* of the upper flange 310 may be caused to be located in a space above the first bending portion that is provided between the boundary H between the first support surface 341*a* and the first curved surface 351*a* and an outer surface 320*a* of the side flange 320. Since the side surface 310*g* of the upper flange 310 extends from the side end edge 310*f* of the upper flange 310 in a direction perpendicular to the first support surface 341*a*, the side surface 310*g* of the upper flange 310 may be located in the space above the first bending portion 351 provided between the boundary H between the first support surface 341*a* and the first curved surface 351*a* and the outer surface 320*a* of the side flange 320.

Since the side end edge 310*f* of the upper flange 310 is connected to the first curved surface 351*a* while adjoining the first curved surface 351*a*, the side end edge 310*f* of the upper flange 310 may be prevented from being exposed to the outside or the degree to which the side end edge 310*f* protrudes beyond the first support portion 341 in a lateral direction or is exposed to the outside may be minimized, thereby preventing an injury by the sharp edge of the upper flange 310. In addition, since a separate welding operation or a coupling member to finish the edge of the door 100 that is formed when the upper flange 310 adjoins the side flange 320 is not required, the aesthetic feeling may be improved, and the manufacturing process may be simplified.

On the other hand, the side flange 320 may include a cut portion 321 formed on the upper end of the side flange 320 to manufacture the first bending portion 351, and may include a flat panel portion 322 separated from the first bending portion 351 by the cut portion 321. The cut portion 321 may be formed to bend a metal plate to manufacture the first bending portion 351.

Figure 9:
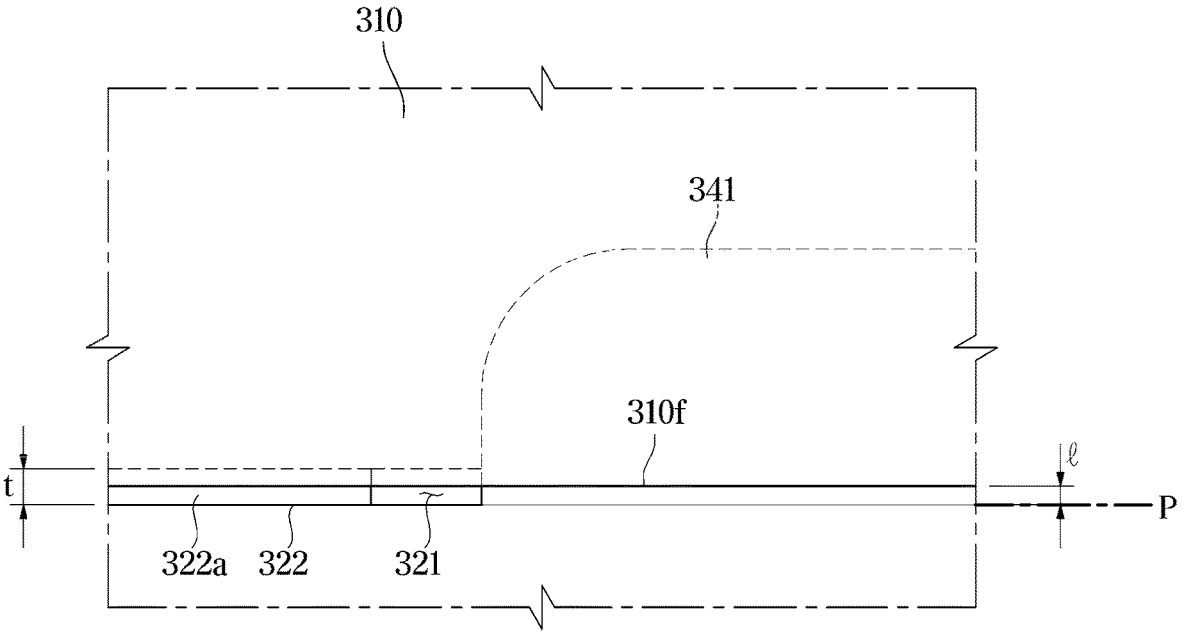
FIG. 9 illustrates an enlarged view of a flat panel portion and an upper flange of the chassis shown in FIG. 3 according to an embodiment of the disclosure.

FIG. 9 illustrates an enlarged view of the flat panel portion and the upper flange of the chassis shown in FIG. 3 according to an embodiment of the disclosure. Referring to FIG. 9, a part of the upper flange 310 may cover a part of an upper surface 322*a* of the flat panel portion 322. In detail, the distance 1 between the side end edge 310*f* of the upper flange 310 and a plane P including the outer surface 320*a* of the side flange 320 may be smaller than the thickness t of the flat panel portion 322, which is the same as the thickness t of the side flange 320.

Since the thickness t of the flat panel portion 322 corresponds to a distance between the outer surface 320*a* of the side flange 320 and an inner surface 320*b* of the side flange 320, when the distance 1 between the plane P including the outer surface 320*a* of the side flange 320 and the side end edge 310*f* of the upper flange 310 is smaller than the thickness t of the flat panel portion 322, the side end edge 310*f* of the upper flange 310 may be located on the upper surface 322*a* of the flat panel portion 322, and the lower surface 310*c* of the upper flange 310 may cover a part of the upper surface 322*a* of the flat panel portion 322. In this case, the side end edge 310*f* of the upper flange 310 may be located at the boundary H between the first support surface 341*a* and the first curved surface 351*a*, or may be located between the boundary H between the first support surface 341*a* and the first curved surface 351*a* and the outer surface 320*a* of the side flange 320.

As such, a sheared upper surface 322*a* of the flat panel portion 322 is provided to be covered by the upper flange 310, so that a risk of injury due to the sheared surface of the flat panel portion 322 may be reduced.

However, the disclosure is not limited thereto, and the upper flange 310 of the home appliance shown in FIG. 1 may not cover the upper surface 322*a* of the flat panel portion 322. Accordingly, the upper surface 322*a* of the flat panel portion 322 may be completely exposed.

The chassis 200 may include a second support flange 332 that is formed by being bent at an upper end of the first rear flange 361. The second support flange 332 may include a pair of second support flanges 332 respectively formed by being bent at the upper ends of the pair of first rear flanges 361 respectively formed by being bent from the pair of side flanges 320.

The second support flange 332 may come in contact with the upper flange 310 and may support the upper flange 310. The second supporting flange 332 may include a second supporting portion 342 configured to come in contact with the upper flange 310 and a second bending portion 352 configured to connect the second supporting portion 342 to the first rear flange 361.

The second support portion 342 may have a shape of a flat panel parallel to the upper flange 310. The second support portion 342 may include a second support surface 342*a* that may come in contact with the lower surface 310*c* of the upper flange 310. In detail, the second support surface 342*a* may have a planar shape and correspond to an upper surface of the second support portion 342.

The second bending portion 352 may have a shape of a bent plate having one end connected to the first rear flange 361 and the other end connected to the second support portion 342. The second bending portion 352 may include a second curved surface 352*a* having a curved shape. The second curved surface 352*a* may have a constant or varying curvature. The second curved surface 352*a* may correspond to an outer surface of the second bending portion 352 and may be connected to the second support surface 342*a*.

As the second curved surface 352*a* and the second support surface 342*a* are connected to each other, a boundary V may be formed, and the second support portion 342 and the second bending portion 352 may be distinguished from each other based on the boundary V.

The upper flange 310 may be disposed on the second support portion 342 so that the rear end portion of the upper flange 310 is positioned on the boundary V between the second support portion 342 and the second bending portion 352. In detail, as the upper flange 310 comes in contact with the second support surface 342*a*, a rear end edge 310*b* of the upper flange 310 is caused to be located at a position corresponding to an upper portion of the second bending portion 352 and also corresponding to the boundary V between the second support surface 342*a* and the second curved surface 352*a*. Since the rear surface 310*a* of the upper flange 310 extends from the rear end edge 310*b* of the upper flange 310 in a direction perpendicular to the second support surface 342*a*, the rear surface 310*a* of the upper flange 310 may be located on the boundary V between the second support surface 342*a* and the second curved surface 352*a*.

Figure 8:
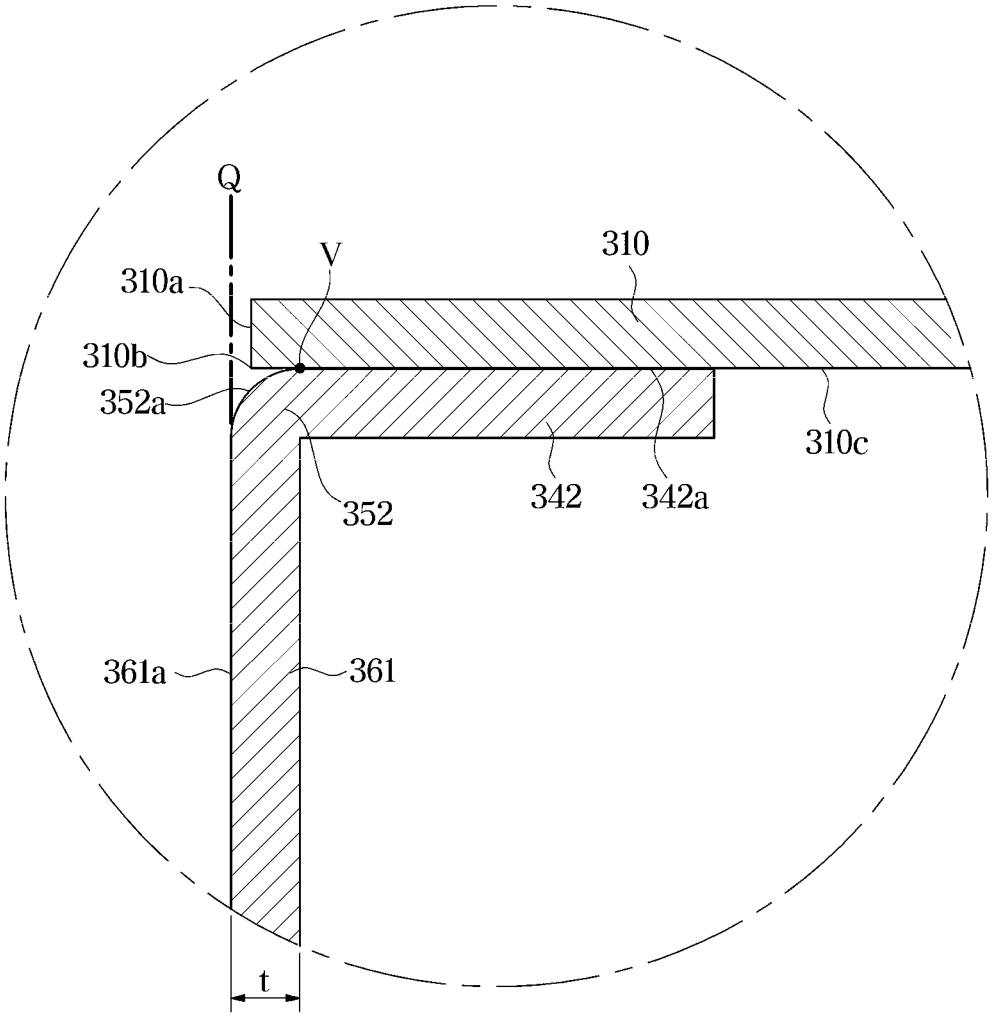
FIG. 8 illustrates a view taken along line C-C' of FIG. 3, which shows a second support flange and an upper flange according to the second embodiment of the disclosure.

However, the disclosure is not limited thereto. FIG. 8 illustrates a view taken along line C-C' of FIG. 3, which shows the second support flange and the upper flange according to the second embodiment of the disclosure. Referring to FIG. 8, the upper flange 310 may be disposed on the second support portion 342 so that the rear end portion is located in a space above the second bending portion 352.

In detail, as the upper flange 310 comes in contact with the second support surface 342*a*, the rear end edge 310*b* of the upper flange 310 may be caused to be located in a space above the second bending portion that is provided between the boundary V between the second support surface 342*a* and the second curved surface 352*a* and an outer surface 361*a* of the first rear flange 361. Since the rear surface 310*a* of the upper flange 310 extends from the rear end edge 310*b* of the upper flange 310 in a direction perpendicular to the second support surface 342*a*, the rear surface 310*a* of the upper flange 310 may be located in the space above the second bending portion 352 provided between the boundary V between the second support surface 342*a* and the second curved surface 352*a* and the outer surface 361*a* of the first rear flange 361.

Similar to the first support flange 331, the distance between the rear end edge 310*b* of the upper flange 310 and a plane Q including the outer surface 361*a* of the first rear flange 361 may be smaller than or equal to the thickness t of the first rear flange 361. Since the chassis 200 is formed of a single metal plate, the thickness t of the first rear flange 361 may be the same as the thickness t of the side flange 320.

Since the rear end edge 310*b* of the upper flange 310 is connected to the second curved surface 352*a* while adjoining the second curved surface 352*a*, the rear end edge 310*b* of the upper flange 310 may be prevented from being exposed to the outside or the degree to which the rear end edge 310*b* protrudes beyond the second support portion 342 in a lateral direction or is exposed to the outside may be minimized, thereby preventing an injury by the sharp edge of the upper flange 310. In addition, since a separate welding operation or a coupling member to finish the edge of the door 100 that is formed when the upper flange 310 adjoins the first rear flange 361 is not required, the aesthetic feeling may be improved, and the manufacturing process may be simplified.

When the chassis 200 includes the first support flange 331 and the second support flange 332, it can be seen that the support flange 330 is provided at a rear side corner of the chassis 200. In detail, the support flange 330 is referred to as being provided in a corner upper portion formed between the side flange 320 and the first rear flange 361.

In this case, the chassis 200 may include a third support flange 333. The third support flange 333 may be formed at a corner where the first rear flange 361 is bent from the side flange 320, and the third support flange 333 may connect the first support flange 331 to the second support flange 332. Similar to the second support flange 332, the third support flange 333 may include a third support portion 343, a third bending portion 353, a third support surface 343*a*, and a third curved surface 353*a*.

The first support flange 331, the second support flange 332, and the third support flange 333 may be integrally formed with each other. The support flange 330 may include the first support flange 331, the second support flange 332, and the third support flange 333. The support flange 330 may include a support portion 340 including the first support portion 341, the second support portion 342, and the third support portion 343. The support flange 330 may include a bending portion 350 including the first bending portion 351, the second bending portion 352, and the third bending portion 353. The support portion 340 may include a support surface 340*a* including the first support surface 341*a*, the second support surface 342*a*, and the third support surface 343*a*. The bending portion 350 may include a curved surface 350*a* including the first curved surface 351*a*, the second curved surface 352*a*, and the third curved surface 353*a*.

Figure 10:
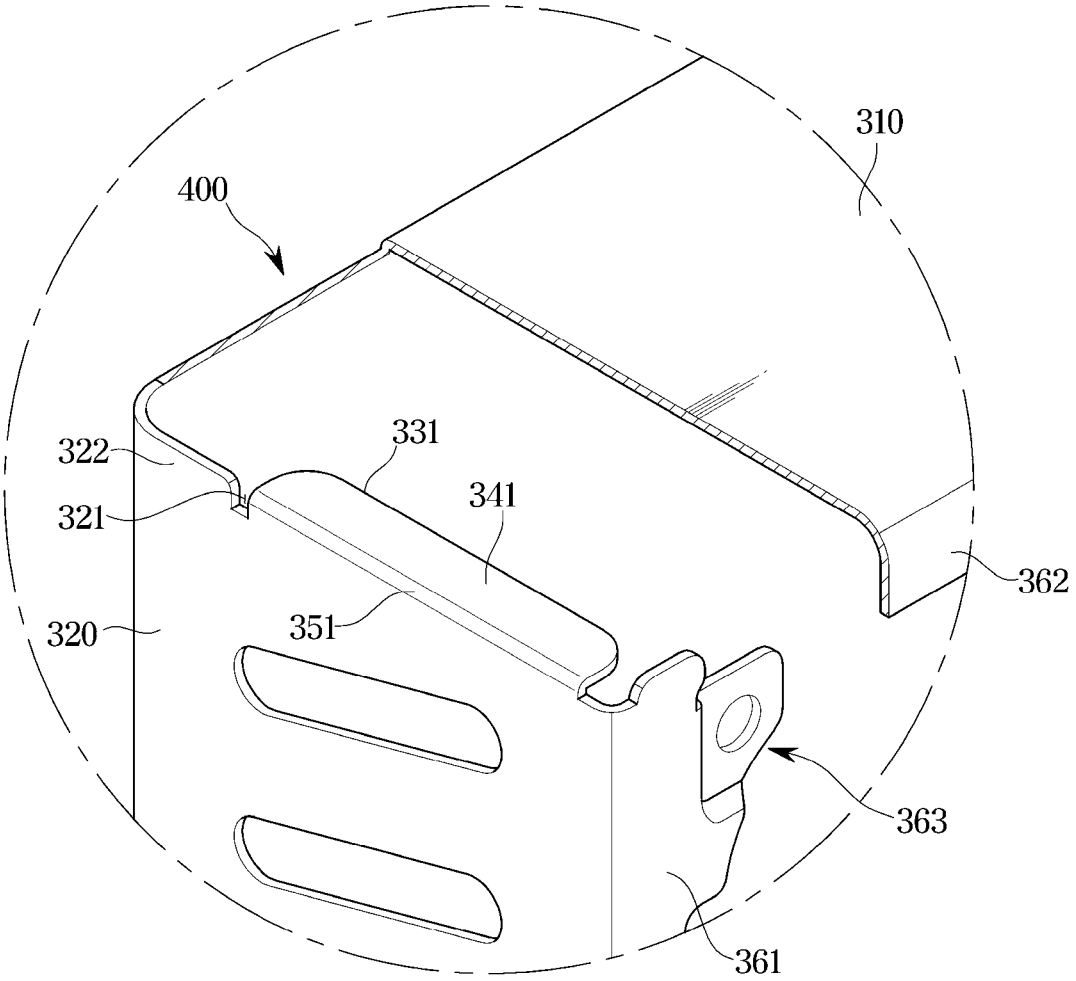
FIG. 10 illustrates a partially cutaway view of a chassis of a door of a home appliance according to another embodiment of the disclosure.

However, the disclosure is not limited thereto. FIG. 10 illustrates a partially cutaway view of a chassis 400 *f* a door of a home appliance according to another embodiment of the disclosure.

Referring to FIG. 10, the second support flange 332 and the third support flange 333 may be omitted in the chassis 400. In this case, since the support flange 330 is not provided on the upper end of the first rear flange 361, there is no need to bend a metal plate, so that the first rear flange 361 is provided with a smaller length in a direction perpendicular to the side flange 320 compared to when a support flange is provided at the upper end of the first rear flange 361. Accordingly, the amount and size of the plate material used to manufacture the chassis 400 may be reduced, and the chassis 400 for a door may be provided in a compact size.

The first rear flange 361 may include a first fastening hole 361*b*, and the second rear flange 362 may include a second fastening hole 362*a* corresponding to the first fastening hole 361*b*.

In detail, the first rear flange 361 may include a recess portion 363 formed as a depression on the outer surface 361*a* of the first rear flange 361 forming the rear surface of the door 100 that is depressed in a direction toward the front panel 210, and the first fastening hole 361*b* may be formed to pass through a surface 363*a* of the recess portion 363 that forms the recess portion 363 and extending parallel to the front panel 210. The second fastening hole 362*a* may be formed to pass through the second rear flange 362 at a position corresponding to the first fastening hole 361*b*.

A part of the second rear flange 362 may be inserted into and seated in the recess portion 363. The part of the second rear flange 362 inserted into the recess portion 363 is a part in which the second fastening hole 362*a* is formed, so that when the part of the second rear flange 362 is inserted into the recess portion 363 of the first rear flange 361, the first fastening hole 361*b* and the second fastening hole 362*a* may overlap each other. By a conventional rivet, pin, or screw passing through the first fastening hole 361*b* and the second fastening hole 362*a*, the first rear flange 361 may be coupled to the second rear flange 362.

As such, the second rear flange may be fixed to the first rear flange using conventional fastening members, such as rivets, pins, screws, etc. without a separate welding operation or a special fastening member, and the number of fastening members may also be minimized, so that the manufacture of the chassis and the door may be facilitated.

As is apparent from the above, a sharp edge formed on an upper flange of a door and a curved surface of a support flange are connected while adjoining each other, so that the sharp edge is prevented from being exposed to the outside, thereby preventing an injury due to the sharp edge.

The door manufacturing process can be simplified by covering edges of a door corner portion without a welding process or additional parts.

Although few embodiments of the disclosure have been shown and described, the above embodiment is illustrative purpose only, and it would be appreciated by those skilled in the art that changes and modifications may be made in these embodiments without departing from the principles and scope of the disclosure, the scope of which is defined in the claims and their equivalents.

Although the present disclosure has been described with various embodiments, various changes and modifications may be suggested to one skilled in the art. It is intended that the present disclosure encompass such changes and modifications as fall within the scope of the appended claims.

What is claimed is:

1. A home appliance comprising:

a body including a chamber; and a door configured to open and close the chamber, wherein the door includes:

a front panel defining a front surface of the door, which is opposite to the chamber when the chamber is closed by the door;

a door side portion defining a side surface of the door, the door side portion extending from one side of the front panel by being bent;

a door upper portion defining an upper surface of the door, the door upper portion extending from an upper end of the front panel by being bent;

a door rear portion a portion of a rear surface of the door, the door rear portion extending from a rear side of the door side portion by being bent;

a first support flange extending from an upper end of the door side portion to inner side of the door by being bent at the upper end of the door side portion, the first support flange including a first support portion configured to come in contact with door upper portion, and a first bending portion connecting the door side portion to the first support portion, the first support portion and the first bending portion are spaced apart from the front panel;

a second support flange extending from an upper end of the door rear portion to inner side of the door by being bent, the second support flange including a second support portion configured to come in contact with the door upper portion, and a second bending portion connecting the door rear portion to the second support portion; and a third support flange connecting the first support flange to the second support flange, the third support flange including a third support portion configured to come in contact with the door upper portion and a third bending portion connected to the third support portion between the first bending portion and the second bending portion, the third support portion having a groove shape formed between the first support portion and the second support portion, wherein the door upper portion covers at least some portion of the first support flange, at least some portion of the second support flange, and at least some portion of the third support flange, and wherein the door side portion includes a cut portion formed on the upper end of the door side portion, and a flat panel portion separated from the first bending portion by the cut portion, so that the first bending portion is bendable at the upper end of the door side portion.

2. The home appliance of claim 1, wherein an end of the door upper portion is on the first support portion.

3. The home appliance of claim 1, wherein the door upper portion is on the first support portion such that an end of the door upper portion is positioned on an upper side of the first bending portion.

4. The home appliance of claim 3, wherein:

the first support portion includes a support surface of a planar shape;

the first bending portion includes a curved surface connected to the support surface; and an edge of one end of the door upper portion is arranged on a boundary between the support surface and the curved surface.

5. The home appliance of claim 4, wherein the support surface supports the door upper portion while in contact with a lower surface of the door upper portion.

6. The home appliance of claim 4, wherein the second support portion comes in contact with a lower surface of the door upper portion, and the door upper portion is arranged on the second support portion such that an other end of the door upper portion is located on an upper portion of the second bending portion.

7. The home appliance of claim 4, wherein:

the door rear portion is a first rear flange; and the door further includes a second rear flange formed by being bent from the door upper portion and fixed to the first rear flange.

8. The home appliance of claim 3, wherein:

the door rear portion is a first rear flange, and the door includes a second rear flange formed by being bent from the door upper portion to form a part of the rear surface of the door, wherein the first bending portion is configured to extend along a first sub-section of the side surface of the door and the first support portion is configured to extend along a second sub-section of the side surface of the door, the second sub-section being smaller than the first sub-section, and wherein the second rear flange is fixed to the first rear flange.

9. The home appliance of claim 8, wherein the first rear flange includes a first fastening hole, and the second rear flange includes a second fastening hole corresponding to the first fastening hole.

10. The home appliance of claim 9, wherein:

the first rear flange includes a recess portion formed to allow a part of the second rear flange to be inserted thereinto; and the first fastening hole is formed in one surface of the recess portion.

11. The home appliance of claim 10, wherein the second rear flange is coupled to the first rear flange by a fastening member that passes through the first fastening hole and the second fastening hole.

12. The home appliance of claim 1, wherein:

one end of the door upper portion is spaced apart from a plane including an outer surface of the door side portion by a distance that is smaller than a thickness of the flat panel portion; and a part of the door upper portion covers a part of an upper surface of the flat panel portion.

13. The home appliance of claim 1, wherein the door upper portion extends for preventing an end of the door upper portion from exceeding beyond a plane including an outer surface of a side flange.

14. A door used for a home appliance, the door configured to open and close a chamber of the home appliance, and including a chassis defining a front surface, a side surface, and a part of a rear surface of the door, the door comprising:

the chassis including:

a front panel defining the front surface of the door, which is opposite to the chamber when the chamber is closed by the door;

a side flange defining a side surface of the door, the side flange extending from one side of the front panel by being bent;

an upper flange defining an upper surface of the door, the upper flange extending from an upper end of the front panel different by being bent;

a rear flange a portion of a rear surface of the door, the rear flange extending from a rear side of a door side portion by being bent;

a first support flange positioned on a corner upper side of the side flange to support the upper flange, and including a first support surface of a planar shape and a first curved surface connecting the side flange to the first support surface, the first support surface and the first curved surface are spaced apart from the front panel;

a second support flange positioned at a corner upper side of the rear flange to support the upper flange, and including a second support surface of a planar shape, and a second curved surface connecting the rear flange to the second support surface; and a third support flange connecting the first support flange to the second support flange, and including a third support surface of a planar shape between the first support surface and the second support surface, and a third curved surface connected to the third support surface between the first curved surface and the second curved surface, the third support surface having a groove shape formed between the first support surface and the second support surface, wherein the upper flange covers at least some portion of the first support flange, at least some portion of the second support flange, and at least some portion of the third support flange, wherein the side flange includes a cut portion formed on the upper end of the side flange, and a flat panel portion separated from the first curved surface by the cut portion, so that the first curved surface is bendable at the upper end of the side flange.

* * * * *